US007980837B2

(12) United States Patent
Moore

(10) Patent No.: US 7,980,837 B2
(45) Date of Patent: Jul. 19, 2011

(54) SELF-ALIGNING ROTARY PISTONE MACHINE

(75) Inventor: Garry Moore, Essex (GB)

(73) Assignee: Phoenix Product Development, Limited, London (GB)

( * ) Notice: Subject to any disclaimer, the term of this patent is extended or adjusted under 35 U.S.C. 154(b) by 605 days.

(21) Appl. No.: 12/066,517

(22) PCT Filed: Sep. 11, 2006

(86) PCT No.: PCT/GB2006/003362

§ 371 (c)(1),
(2), (4) Date: Mar. 12, 2008

(87) PCT Pub. No.: WO2007/031724

PCT Pub. Date: Mar. 22, 2007

(65) Prior Publication Data

US 2008/0253915 A1 Oct. 16, 2008

(30) Foreign Application Priority Data

Sep. 12, 2005 (GB) ..... 0518573.1

(51) Int. Cl.
*F04C 2/00* (2006.01)
*F04C 18/00* (2006.01)

(52) U.S. Cl. ..... 418/268; 418/259; 418/145; 418/148

(58) Field of Classification Search ..... 418/259, 418/266–268, 145, 146, 148
See application file for complete search history.

(56) References Cited

U.S. PATENT DOCUMENTS

| | | | | |
|---|---|---|---|---|
| 1,343,115 | A | 6/1920 | Current | |
| 2,430,251 | A | 9/1944 | Sharp | |
| 2,487,685 | A * | 11/1949 | Young | 418/83 |
| 4,106,472 | A | 8/1978 | Rusk | |
| 5,163,825 | A * | 11/1992 | Oetting | 418/153 |
| 5,346,234 | A * | 9/1994 | Kadaja | 418/266 |
| 5,567,139 | A | 10/1996 | Weatherston | |

FOREIGN PATENT DOCUMENTS

| | | | |
|---|---|---|---|
| CH | 97498 | | 2/1923 |
| DE | 3401030 | A1 | 7/1985 |
| EP | 1167769 | A3 | 1/2003 |
| GB | 26604 | | 9/1914 |
| GB | 1109401 | | 4/1968 |
| GB | 2292186 | A | 2/1996 |
| JP | 06147137 | | 12/1991 |
| WO | 9639982 | A1 | 12/1996 |

* cited by examiner

*Primary Examiner* — Theresa Trieu
(74) *Attorney, Agent, or Firm* — Brooks Kushman P.C.

(57) ABSTRACT

A rotary piston machine has a cylinder provided with two ends to form a stator with inlet and outlet apertures, and a piston having a rotor eccentrically mounted within the stator. A vane is connected to the rotor by a hinge and forms an expanding and contracting chamber as the piston rotates. The piston is provided with a sealing means sufficient to restrict movement of gaseous/fluid matter between chambers during operation. The sealing means includes a flexible seal member with a mating lip positioned adjacent to the vane hinge. Each revolution of the eccentrically mounted piston causes the seal member to contact an inner cylinder wall to prevent the escape of displaced gaseous/fluid matter past the vane hinge. The flexible seal member contacts the cylinder wall and bends to form a lip seal resistive to the direction of pressurization.

12 Claims, 4 Drawing Sheets

65°
51°
A

SELF-ALIGNING ROTARY PISTONE MACHINE

This invention relates to a rotary piston machine of the hinged vane type, and in particular a machine whose operation causes alignment of the component parts to simplify production and accommodate manufacturing discrepancies.

As efforts are made to conserve water, it is becoming increasingly advantageous to transport wastewater by pneumatic means. This is particularly applicable to water closets where large reductions in water use can be achieved by using compressed air to flush instead of water. Such systems generally require large volumes of air to operate, but high initial loads created by stationary wastewater make centrifugal compressors unsuitable because of their inherent stalling characteristics. In contrast, rotary piston compressors can deliver high volumes of positively displaced air to overcome high initial loads, but known rotary piston machines require precise machining and assembly during manufacture to achieve the close dimensional tolerances between component parts that is necessary to avoid operational failure through internal losses and seizure. This intensive manufacturing process is not economically viable for light-duty, low-cost applications such as water closets and building drainage systems.

It is an object of the present invention to obviate or mitigate these manufacturing difficulties by providing a rotary piston machine that can be easily produced through the plastic injection moulding process, has a simple assembly procedure of the component parts, and will automatically adjust during operation to accommodate a wide range of manufacturing inconsistencies and component distortion to prevent internal losses and seizure.

Accordingly, in one non-limiting embodiment of the present invention there is provided a rotary piston machine comprising a cylinder provided with two ends to form a stator, inlet and outlet apertures disposed in the stator, a rotor eccentrically mounted within the stator, at least one vane connected to the rotor and in communication with the cylinder to form an expanding and contracting chamber as the piston rotates, the vane being substantially rigid perpendicular to its line of contact with the rotor but axially and torsionally deformable to allow the internal pressure generated during displacement to force the vane into simultaneous colinear alignment with the rotor and the cylinder such that incompatibilities in the component parts are reconciled.

The present invention may comprise a rotary piston machine suitable for light duty applications whose component parts can be cost-effectively produced through the plastic injection moulding process. It is advantageous for such components to possess relatively thin, uniform wall sections to avoid polymer shrinkage during manufacture, and to minimise material costs. It is also advantageous for components to be void of undercuts, which can inhibit mould separation and removal of parts.

Construction of the components of the present invention is preferably by thin wall sections whose strength axis is reinforced by thin wall rib sections disposed between the wall sections such that operational stresses are distributed, at least partially, throughout the component. Orientation of the wall and rib sections may be such that manufacture by the plastic moulding process is not convoluted. The benefit of this arrangement is that polymer components reinforced with ribs exhibit controlled deformable qualities that enhance successful operation of the present invention. Alternative methods and materials of construction of the component parts may be employed, including, extrusion, casting, vacuum forming, machining, blow-moulding, compression moulding, cutting, welding or the like in plastic, metal, ceramic, glass, composites or the like.

The rotary piston machine is preferably one in which the two ends of the cylinder are end caps.

The said at least one vane is preferably pivotally connected to the rotor. The said at least one vane may however be a sliding vane.

In a preferred embodiment of the present invention, the rotor is provided with four vanes disposed around its periphery. This arrangement has the advantage of allowing the rotor to possess a square section profile of equilateral geometry to aid de-moulding during manufacture. Preferably, the four vanes are equally disposed around the periphery of the rotor. Each vane may have a curved outer face to maximise displacement against the cylinder wall; the curved outer face having a greater radius than the cylinder bore so that concentric contact with the cylinder wall is avoided during operation, thus allowing the leading edge of the vane to provide a continuous sliding seal. Different quantities of vanes and alternative profiles and spacing of the components may be employed.

The means to pivotally connect each vane to the rotor may comprise a hinge. In a preferred embodiment of the invention, the hinge is created by the operation of the machine; the pressure created during displacement providing sufficient force to abut the mating portions of the vane and rotor, whereupon the vane, being deformable, assumes the same longitudinal profile as the rotor to form a hermetic join; the vane continuously adjusting during operation to align with operational deflections in rotor geometry. Where such open hinge configuration is employed, the mating surfaces may be curved to provide a smooth bearing surface to aid continuous hermetic pivoting. Additional means of providing the piston hinge may include a conventional butting hinge, collars provided in the rotor and vane connected with a captive hinge pin, a 'snap-fit' socket and engaging means or, where the rotor and vane are manufactured in plastic, a 'living-hinge', where construction of the part includes a bending element positioned at the required point of hinging. Further means may comprise interspersed variations of the above in either the rotor or vane.

The rotary piston machine may be one in which the rotor has four of the hinges, in which the four hinges are equally spaced, in which the rotor includes perpendicular reinforcement ribs, and in which there are no undercuts under the hinges or the perpendicular reinforcement ribs.

Means may be provided to locate each vane on the rotor such that when the piston is at rest and pressure is not being applied to the vane to form the hinge, the vane remains in a position to correctly engage the rotor upon subsequent movement of the piston. Such means may comprise sockets disposed in the rotor end faces of a suitable profile to accommodate the ends of the mating section of the vanes. Additional means may be provided to restrict longitudinal movement of the vane on the rotor sufficient to prohibit contact between the vane end faces and the cylinder end caps. Such captive engaging means may comprise an arrangement whereby the vane may slide into the rotor sockets at its maximum hinged opening angle, and subsequent closure of the vane onto the rotor acts to engage the means to restrict longitudinal movement. Such an arrangement has the benefit that once the piston is assembled in the stator, its proximity to the cylinder does not allow the vanes to attain the maximum hinging angle necessary to disengage the means to restrict longitudinal movement of the vane, thus holding the vane captive. Additional means to secure the vane in position may include a pin and socket, peg and hole, hook and eye, catch and pin, 'snap-fit' socket, or interspersed variations thereof on either the vane or rotor.

The piston may be provided with sealing means sufficient to restrict the movement of air between chambers during operation. The sealing means may comprise a seal positioned adjacent to each vane hinge such that each revolution of the eccentrically mounted piston causes each seal to come into contact with the cylinder wall sufficient to prevent the escape of displaced air over the vane hinge. The sealing means may be provided on the rotor, vane or incorporated into the hinge. The sealing means may comprise a flexible member such that as its mating lip contacts the cylinder wall, it bends to form a lip seal resistive to the direction of pressurisation. Alternative sealing means may comprise rigid seals. Such rigid seals may be provided with means to pivotally attach them to the piston. Such rigid seals may alternatively be provided with means to slide inside the piston upon contact with the cylinder wall whereupon continual contact with the cylinder wall sufficient to maintain an effective seal may comprise centrifugal force or spring arrangements. The sealing means may include the vanes. The piston of the present invention may be used with or without seals.

Where high displacement volumes are required, but space is restricted, it is effective to provide an elongated piston and cylinder. However, this creates a problem with the transmission of torque through the piston, as rotors tend to twist under load, especially when constructed in plastic. While certain polymers may be used with fillers to increase torsional rigidity, the rotor of the present invention is preferably moulded over a metallic shaft to increase rigidity. Such shafts may be provided with splines, grooves, cuts or surface texture to aid bonding and give even transmission of torque. Further embodiments may produce the rotor entirely in metal through the die-cast process, and may, or may not, be provided with non-metallic inserts at contact points to improve running and wear characteristics.

The cylinder may have parallel or tapered walls, and a round or off-round section profile, depending on the method of production. Production is preferably by injection moulding, extruding or turning to produce a thin walled plastic cylinder, whereby consistent dimensional accuracy may be difficult to achieve. Preferably, the end caps are a tight fit over the cylinder to compensate for manufacturing inconsistencies by encouraging a round profile and minimising elliptical deflection during operation. When the cylinder has tapered walls, the end caps may be different sizes to reflect the different diameters of the cylinder ends. Means are provided to connect the end caps to the cylinder to form the stator, and further means are provided to mount the stator. One or more end caps may be incorporated onto the cylinder during manufacture to produce a single component. In a preferred embodiment of the present invention, one end cap is incorporated into an enclosure to house or mount the stator.

Eccentric running of the piston in the stator may be accomplished by providing a bearing in each end cap positioned with a common axis offset from the cylinder axis. Such bearings may comprise plain bearings, and the material of construction may be self-lubricating plastic. Other types of bearings and materials may be used and alternative means of lubrication may be employed.

The stator may be provided with inlet and outlet apertures conveniently disposed in the cylinder end caps. Expansion and contraction of the running chambers acting to draw air in through the inlet aperture and expel it through the outlet aperture. Other types of apertures may be employed.

Where the piston comprises four vanes positioned equally around its periphery, they form four equal chambers, with each pair of opposing chambers separated by the adjacent pair of opposing chambers. Where high-volume, low-pressure air displacement is required, it is desirable to vent each chamber throughout its compression and expansion cycle to reduce internal pressures, minimise operating torque and maximise airflow. However, it is desirable to avoid placing the apertures in the cylinder wall as this requires complicated mould design, or secondary operations during manufacture. This problem may be overcome by positioning the apertures in the end caps such that as a chamber reaches the point of maximum expansion, or Top Dead Centre TDC, the outlet aperture is configured to mimic the end profile of the chamber created by the surfaces of the rotor, vane and cylinder as it moves round to the point of maximum contraction, or Bottom Dead Centre BDC, where the displacement ceases. This end profile is of considerable area with the current invention, and provides an aperture of sufficient size to reduce internal pressurisation to acceptable operating levels. The inlet aperture may follow the same principle of construction, except that the end profile of the expanding chamber made by the rotor, vane and cylinder is of a different configuration.

The rotary piston machine may be one in which one or more of the component parts of the rotary piston machine are made of a plastics material.

The mechanism of the present invention may be lubricated or un-lubricated. Where the components are constructed from a plastics material, the plastics material may include at least one friction-reducing polymer additive such for example as polytetrafluoroethylene. Graphite, or other self-lubricating fillers which act to deposit particles onto their mating surfaces to reduce friction may be employed. Alternatively, liquid lubricants such as water, oil, emulsions, or the like, may be used. Alternatively, solid lubricants such as grease or graphite, or combinations of the aforementioned lubricants may be used. Where liquid lubricants are used, they may be distributed throughout the mechanism by its motion and means for their introduction into the machine may include the expanding chamber, whereby fluid is drawn into the chamber by the vacuum created as the chamber expands. Where liquid lubricants are used, polymers may be selected to maximise the lubricating effect, such as nylon, which acts to absorb liquid and release it during operation.

The rotary piston machine may be one in which the rotor comprises the plastics material moulded over a metal shaft. Such a construction may give increased rigidity as compared with moulding the rotor completely of a plastics material.

The present invention also provides a water closet including a rotary piston machine of the invention, the displaced air or vacuum generated during operation of the rotary piston machine being used to operate the water closet.

The present invention also provides a drainage system including a rotary piston machine of the invention, the displaced air or vacuum generated during operation of the rotary piston machine being used to assist transportation of water through the drainage system.

An embodiment of the present invention will now be described, solely by way of example and with reference to the accompanying drawings, in which.

Figures 1, 2, 3, 4, 5:
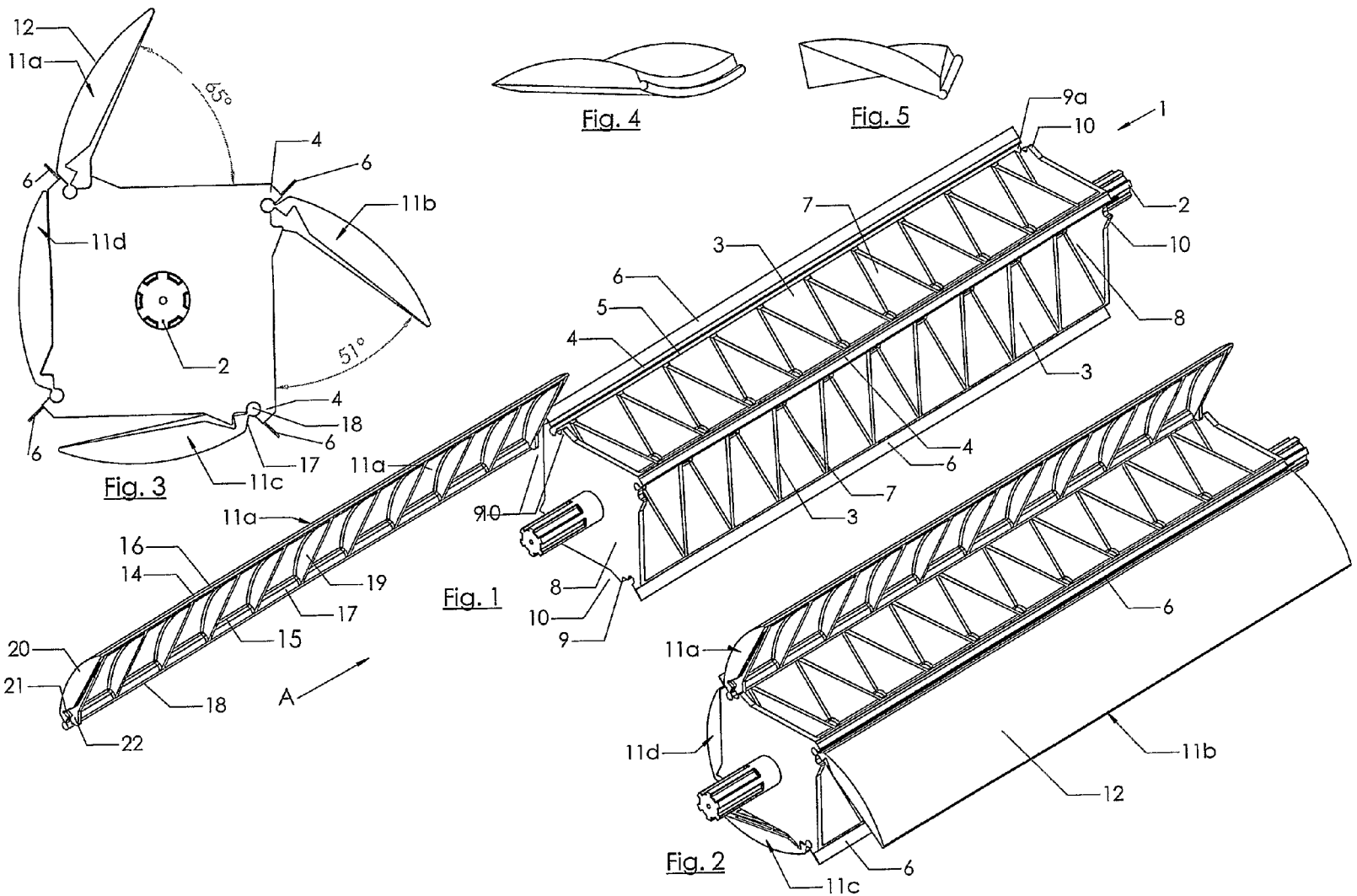
FIG. 1 is a perspective view showing the assembly procedure for locating a vane on the rotor.
FIG. 2 is a perspective view showing four vanes located onto the rotor to form the piston, the vanes being in various stages of closure to engage captive means.
FIG. 3 shows an end view of FIG. 2.
FIG. 4 shows a vane exhibiting axial deformation.
FIG. 5 shows a vane exhibiting torsional deformation.

Referring now to the drawings, FIGS. 1, 2 and 3 show the assembly procedure for locating the vanes onto the rotor to form the piston. The rotor 1 comprises a central shaft 2 with four linear wall sections radiating out at 90° intervals 3. The circumferential edge of each wall is provided with a shoulder along its length 4 and a fillet radius is disposed on the inside of each shoulder to form a concave abutment 5. The shoulder of each wall is further provided with a flexible seal 6 along its length on the outermost plane. A series of perpendicular ribs 7 emanate from the rear of each wall and connect with the front of each adjacent wall to provide support for each abutment 5. Each linear series of ribs is evenly spaced, and each series is offset from each adjacent series for even distribution of operational stresses. Each end face 8 is provided with a concentric continuation of the shoulder fillet to form a socket in the profile of a reflex arc 9, and a spur 10 in proximity to the socket 9. Each vane 11*a, b, d* and *c* comprises a linear surface 12 curved to a greater radius than the internal radius of the cylinder 13 and has a leading edge 14 and a trailing edge 15. The leading edge is provided with a fillet or chamfer 16, and the trailing edge comprises a sloping plane 17 culminating in a protruding abutment 18 having at least part of its perimeter curved to a complementary radius as the rotor shoulder abutment 5. A series of perpendicular ribs 19 traverse the inside surface of the vane to prevent the curved surface 12 straightening during operation, and end walls 20 are provided with rebates 21 sufficient to accommodate the rotor spurs 10 and a spur on each rebate plane 22. The rotor and vane abutments 5 and 18 assume a complementary curved profile to allow concentric alignment and provide a smooth hermetic hinging action under pressure. Further embodiments of the piston hinge arrangement may include a convex profile rotor abutment and a concave profile vane abutment, or a tongue and groove arrangement on the rotor and the vane, or interspersed variations thereof.

FIG. 1 shows how the vane abutment 18 is offered up to the rotor socket 9 with the vane 11*a* held at an angle such that the rotor spur 10 and vane spur 22 are not conflicting so that the vane abutment 18 may engage the rotor socket 9 and slide through in the direction of Arrow A and along the rotor abutment 5 until it engages the socket of the opposite rotor face 9*a*. In a preferred embodiment of the invention, the vane clearance angle is approximately 65 degrees, but other angles may be appropriate for different sizes of machine. FIG. 2 shows the complete piston assembly and how the four vanes 11*a, b, c* and *d* have engaged the rotor sockets 9 and are in the process of being closed so that the vane spurs 22 slide past on the inside of the rotor spurs 10 to prevent the vane disengaging from the rotor sockets 9. FIG. 3 is an end projection of FIG. 2 and shows with more clarity how the entry angle of the vane 11*a* will allow the spurs 10 and 22 to pass without contact, but subsequent closure 11*b, c* and *d* acts to engage the spurs 10 and 22 such that the vane 11 is held captive on the rotor 1. During operation, the maximum running angle obtained by each vane 11 is insufficient to allow the spurs 10 and 22 to disengage, thus holding each vane 11 captive. The angle of 51 degrees indicated by vane 11*b* corresponds to the maximum running angle of the preferred embodiment of the present invention, but other angles may be appropriate for different sizes and shapes of machine. It will be appreciated that although the vanes 11 are held captive on the rotor 1, they are not in hermetic union and operational hinges have not been formed. As there are no hinges to assemble, the assembly procedure is quick and easy, and as the rotor 1 and vane 11 do not require specific alignment, longitudinal deformation of the vane or rotor abutments 5 and 18 will not hinder the assembly procedure.

Other methods of assembly and construction may be employed. For example, where the rotor and vanes are manufactured through machining they may comprise solid forms, or, when manufactured through the extrusion process where it is not possible to produce lateral features such as the ribs, the ribs may be omitted or added as a second operation. The rotor may also comprise a substantially square tube with separate end caps and auxiliary inserts provided over a central shaft to form the end faces and provide internal support to the tube. The rotor may comprise a metallic shaft over which the rotor is moulded or attached, the rotor being provided with splines to assist with the transfer of torque, and to provide a means to engage a motor sufficient to turn the piston. When the piston is driven by a motor, the piston may be actuable electromagnetically.

FIG. 4 shows typical longitudinal deformation of a vane 11, which may be caused by manufacturing error, material stresses within the component or poor storage technique. FIG. 5 shows typical torsional deformation of a vane 11, which may also be caused by manufacturing error, internal material stresses within the component or poor storage technique. The configuration of the vane ribs 19 and flexible nature of the material of construction is such that longitudinal and torsional deformation of the vane 11 may be corrected by the forces generated during operation of the piston. Conversely, non-deformed vanes 11 may acquire longitudinal and torsional deformation by the forces of operation pushing them onto deformed or misaligned surfaces of abutment of the rotor or cylinder 13. The level and orientation of deformity may be controlled by the configuration of reinforcement ribs and/or material selection.

Figure 8:
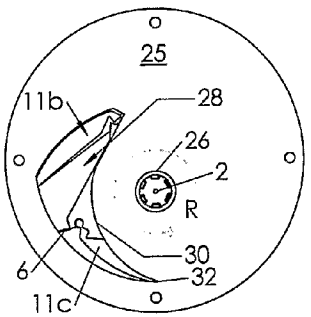
FIGS. 7 and 8 are first angle projection views of FIG. 6.
Figure 6:
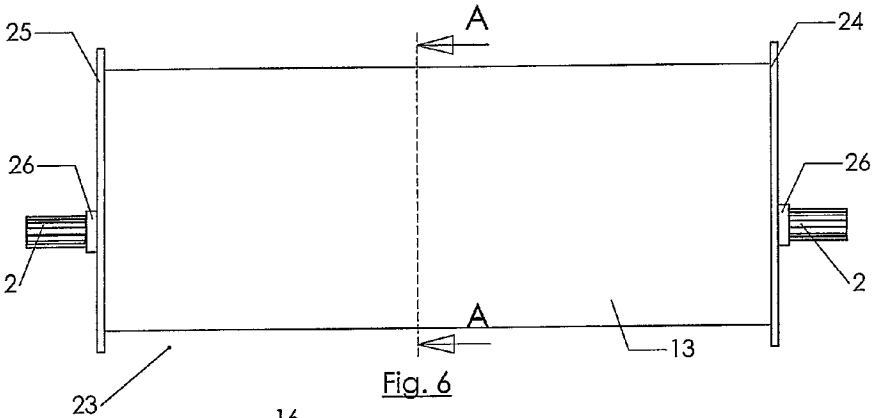
FIG. 6 is a side view of the fully assembled rotary piston machine.
Figure 7:
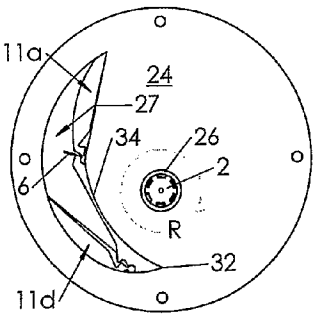

FIG. 6 shows the fully assembled rotary piston machine during operation generally at 23. The end caps 24 and 25 are each provided with a circular recess sufficient to provide a push fit over the cylinder ends whereupon they hold the cylinder 13 in a substantially round position to create a stator. Each end cap is provided with a bearing 26, whose common axis is offset from the cylinder axis. The rotor shaft 2 is located in the bearings 26 to eccentrically mount the piston in the stator. FIG. 7 shows the end cap 24 provided with an inlet aperture 27, while FIG. 8 shows the end cap 25 provided with an outlet aperture 28. The direction of rotation of the piston is shown by the Arrows R.

Figure 9:
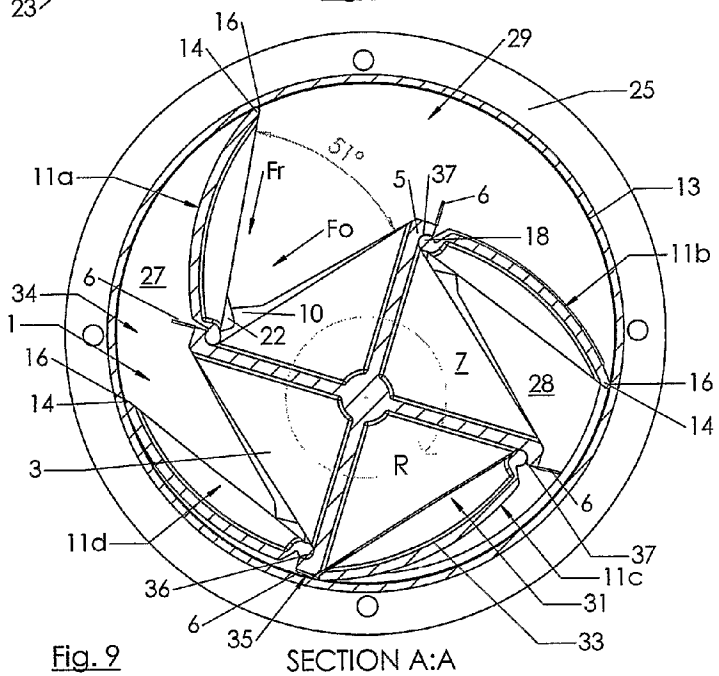
FIG. 9 is a section view of FIG. 6.

FIG. 9 is a cross section view of FIG. 6 and shows how the piston revolves in the direction of Arrow R. The vanes 11 are held captive on the rotor 1 during rest with the rotor and vane abutments 5 and 18 in close proximity to each other. Upon movement of the piston, rotor and vane abutments 5 and 18 abut and the vanes are pushed forwards by the motion of the rotor 1, whereupon centrifugal force acts to move the leading edges of the vanes 14 outward and into contact with the cylinder 13. The displaced air and vacuum created during operation acts to apply force to the vanes 11 in the direction of the arrow Fo as the piston rotates, which pushes each deformable vane into simultaneous hermetic contact with the cylinder wall 13 and rotor abutment 5 to form a hinge 37. Any deflections or misalignments in the rotor or cylinder during operation are accommodated by the force Fo continually pushing the deformable vane 11 into running hermetic contact with its abutting surfaces, even when they are continually changing. The effects of force Fo on the vanes caused by pressurisation are augmented by the force imposed on them by frictional contact with the cylinder, as indicated by the arrow Fr. The leading edges of the vanes 14 may be provided with a fillet or chamfer 16 to aid running contact with the cylinder wall and prevent snagging. Alternatively, the leading edge 14 may be provided with an additional lip or ridge of material to improve running contact and provide more resistance to wear. Such a ridge may be part of the vane or an independent component that is separately attached. Where the ridge would foul the rotor, a rebate may be provided to accommodate the ridge.

The top chamber 29 is shown at TDC position, whereupon the trailing vane 11*a* is at its maximum opening angle and the spurs 10 and 22 are still engaged sufficiently to hold the vane 11 captive on the rotor 1 while the leading vane 11*b* is closing onto the rotor 1 due to eccentric communication with the cylinder 13. At this point, the chamber 29 is not in communication with either aperture 27 and 28 as there is no displacement. As the piston revolves past TDC position, the chamber 29 will contract and displacement commences. Therefore, the configuration of the outlet aperture 28 is such that it mimics the profile of the chamber 29 created by the outer surface 12 of the leading vane 11*b*, the rotor trajectory 30 and the cylinder 13, to allow maximum venting until the trailing vane 11*a* reaches the fully closed position 11*c* and the chamber is at BDC position 31, whereupon displacement ceases and communication with the outlet aperture ceases 32. In this way, the chamber is vented throughout its compression phase and internal pressurisation and consequent torque is minimised. Conversely, as the chamber 31 moves past BDC position, it begins to expand and a vacuum is created. Therefore, the configuration of the inlet aperture 27 is such that it mimics the profile of the chamber 31 created by the inner surface 33 of the trailing vane 11*c*, the rotor trajectory 34 and the cylinder 13, to allow maximum venting until the leading vane 11*d* reaches the fully open position 11*a* and the chamber is once again at TDC position 29, whereupon vacuum ceases and communication with the inlet aperture 27 ceases. In this way, the chamber is vented throughout its vacuum phase and internal pressurisation and consequent torque is minimised.

The advantage of the described arrangement is that linear accuracy of the component parts is not necessary, as, when under pressure, each vane will adjust to assume co-linear alignment with the linear profile of the abutting surfaces of the rotor and cylinder. Therefore, parallel alignment of the rotor and cylinder is unnecessary as the vanes will deform torsionally to accommodate a tapered orientation of the cylinder with respect to the rotor, so the cylinder 13 may be constructed with tapered walls, as necessitated by the plastic injection moulding process, where a draft angle may be required in core elements of moulds to aid extraction of parts, with the torsionally deformable vane simply adapting to the tapered profile once forces Fo and Fr are applied. Such an arrangement has the added advantage that the vanes will also adjust to operational deflections experienced with the twisting characteristics of an elongated rotor under load.

As the chamber 31 approaches the BDC position, the leading adjacent chamber 34 has already entered its expansion phase and is creating a vacuum. Consequently, there is a tendency for the displaced compressed air from the contracting chamber 31 to leak past the gap 35 between the bottom of the rotor 1 and the cylinder 13 and over the leading hinge point 36, whereupon it will lift the vane 11*d* away from communication with the cylinder 13 and/or rotor 1 to enter the vacuum chamber 34. In this way, displaced air is internally re-circulated into the vacuum chamber without being expelled from the outlet aperture 28, thus reducing operating efficiency. To overcome such losses, seals 6 are disposed on the piston such that as each chamber is approaching BDC position, its adjacent seal comes into contact with the cylinder, whereupon it bends back to create a hermetic barrier to resist the transition of air between chambers.

Figure 10:
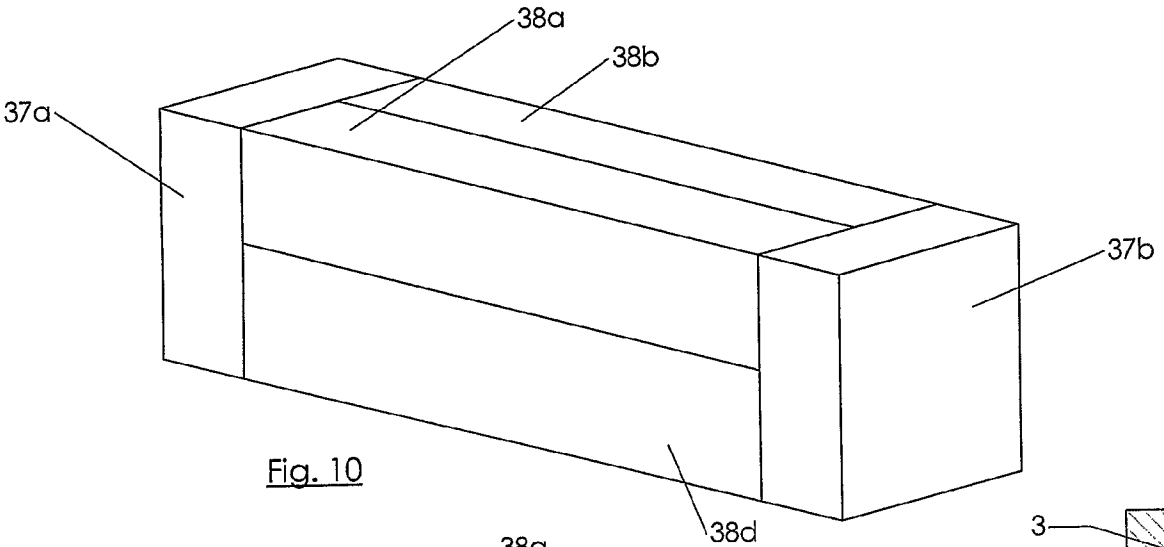
FIG. 10 is a perspective view showing the elements of the moulding process substantially closed.
Figure 11:
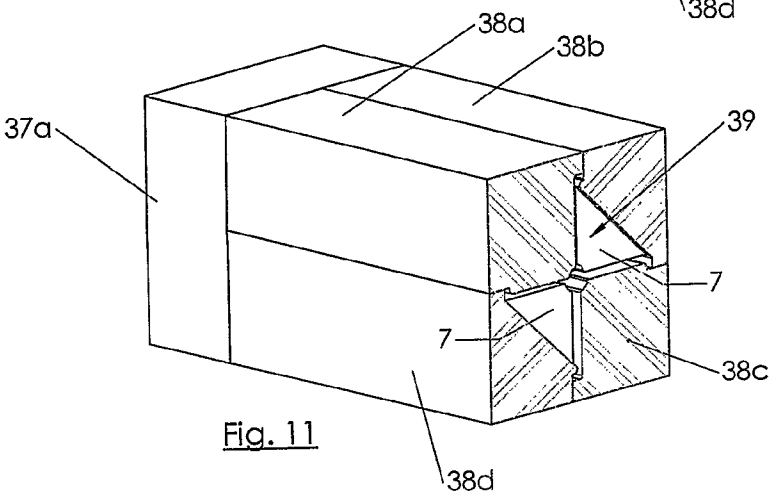
FIG. 11 is a perspective section view of FIG. 10.
Figure 12:
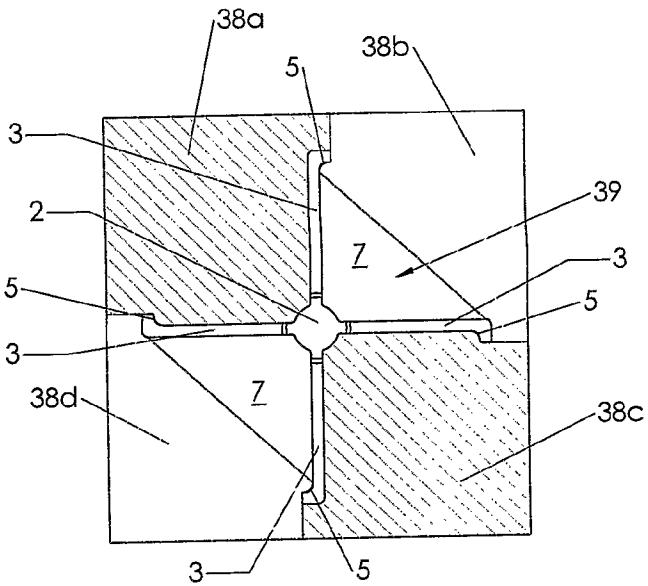
FIG. 12 is an end view of FIG. 11.
Figure 13:
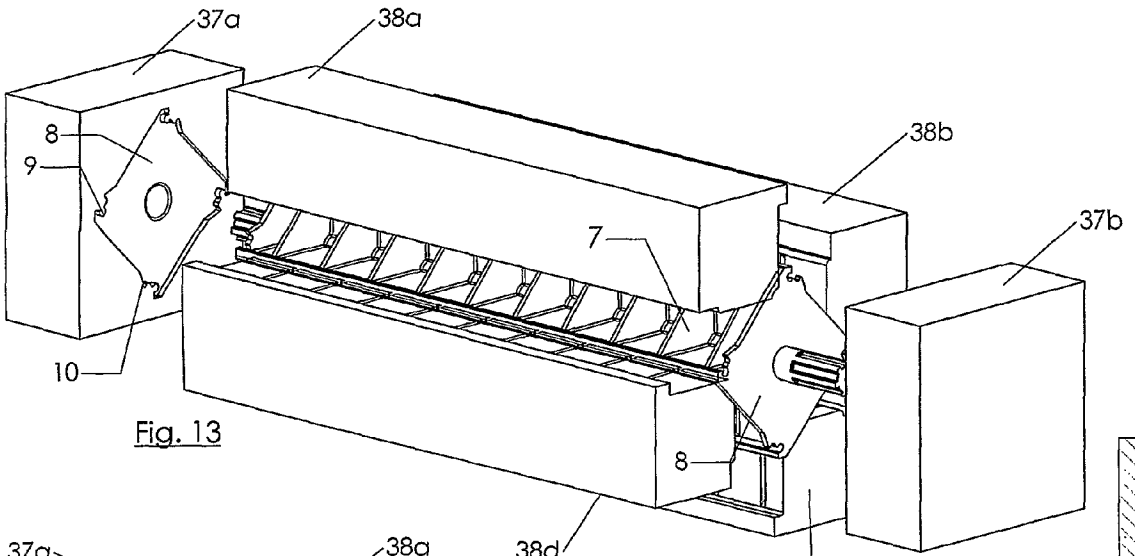
FIG. 13 is a perspective view showing the elements of the moulding process substantially open.
Figure 14:
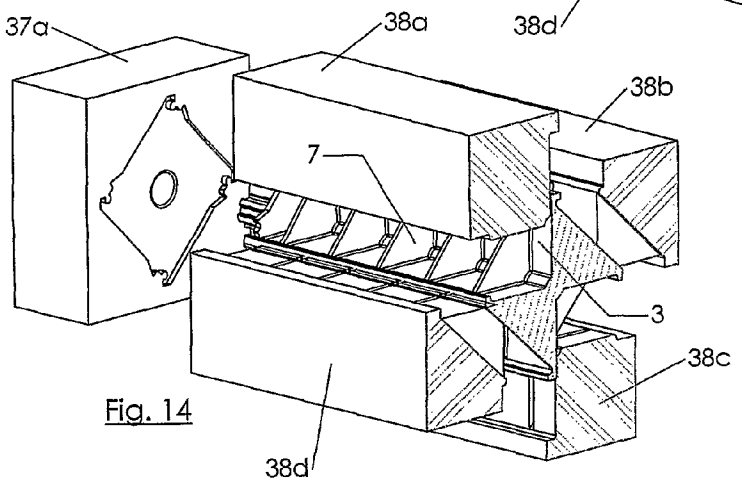
FIG. 14 is a perspective section view of FIG. 13.
Figure 15:
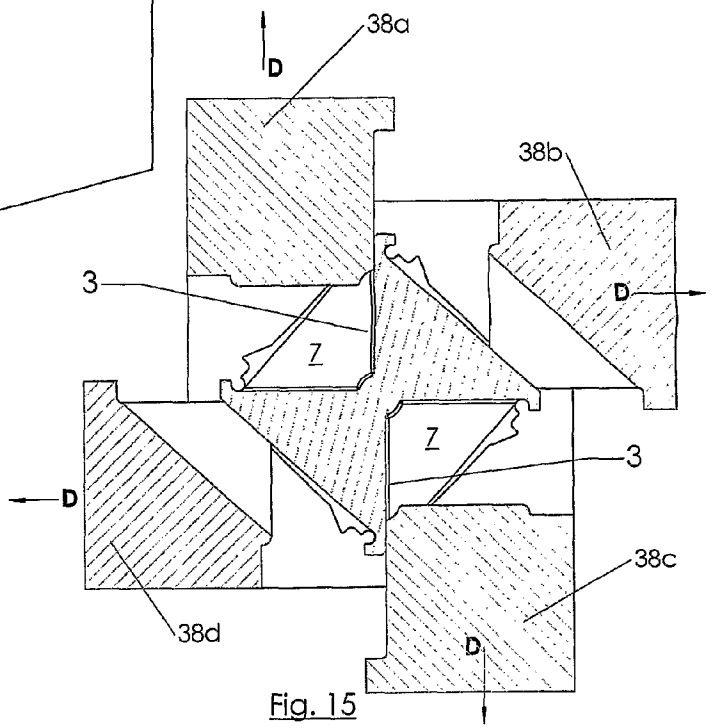
FIG. 15 is an end view of FIG. 14.

FIGS. 10-15 show a method of producing the rotor through the plastic injection moulding process. FIG. 10 shows the main elements of the mould closed to form an internal cavity in the profile of the rotor, with end pieces 37*a* and *b* closed against the side pieces 38*a, b, c* and *d*. FIG. 11 shows a section through FIG. 10 and the mould cavity 39 can be seen in the profile of the rotor. FIG. 12 shows an end view of FIG. 11 with the four side pieces 38 abutted to form the cavity in the profile of the rotor shaft 2, side walls 3, hinge abutments 5 and rib sections 7. With such an arrangement, molten plastic may be injected into the cavity by means not shown, whereupon it will flow to assume the shape of the rotor 1. FIG. 13 shows how the main elements of the mould slide open to release the rotor part once it has been produced. FIG. 14 shows a section view of FIG. 13, and the side pieces 38 can be seen sliding along the backs of the rotors walls 3 to expose the network of ribs 7. The rotor end face 8, socket 9 and spur 10 are created by the mould end pieces 37, leaving straight sliding actions for the four remaining side pieces 38. FIG. 15 shows an end view of FIG. 14 and the way in which the side pieces 38 may slide apart in the direction of the arrows D to release the rotor part 1. It will be appreciated that this straight mould action is possible because the ribs 7 are configured perpendicular to the rotor walls 3 and the hinge abutment 5 is void of undercuts. A metallic shaft 2 may be placed inside the mould prior to moulding to be over-moulded. The rotor walls 3 and ribs 7 may be tapered with draft angles sufficient to aid release from the mould.

In a preferred embodiment of the invention, the action of the compressor is lubricated with water supplied to the inlet aperture. The operation of the machine may draw the water in and circulate it throughout the workings.

In a preferred embodiment of the invention the machine is an air displacement unit for use with pneumatically operated water closets. In a further embodiment of the invention, the machine is for use in building drainage systems. Where the invention is for use with a water closet, the lubricating water may be independently supplied or drawn by the vacuum created during operation. Water may, or may not, be supplied from the cistern.

Where the present invention is connected to a water closet, the wastewater provides a load to the compression chamber such that positive displacement creates back-pressure in the connecting pipe between the compressor and water closet (not shown) sufficient to force the wastewater into, and through, the drainage system. It will be appreciated that with the current invention, difficult loads that may block conventional hydraulic drainage systems can be successfully transported and the volumes of water required to operate drainage systems can be significantly reduced. A further advantage of such an arrangement is that when the wastewater has dissipated along the drainage system and no longer provides a load to the compressor, the characteristics of the rotary piston compressor are such that under no-load conditions, the output becomes a series of positive and negative pulses of air (as opposed to a continuous flow), which has the effect of vibrating the air in the drainage system without displacing it, thus protecting the water trap seals of other appliances from pressure induced emptying. This beneficial characteristic may be controlled by venting the waste-pipe at a given point so that the transported wastewater ceases to provide a load to the compressor. Other forms of rotary piston compressor may be used to operate a water closet or building drainage system in the manner herein described, including a sliding vane compressor, lobe-pump, internal gear pump, external gear pump, rotary screw compressor or wobble pump etc.

While the rotary piston machine of the present invention is intended to be used as an air compressor or blower, it may be modified to pump any gaseous or fluid matter in either pressure or vacuum mode Alternatively, the rotor may be driven through compressed air, vacuum, hydraulic flow, or expanding gas, to form an engine.

When the present invention is used as an engine, compressed air may be introduced to the contracting chamber 29 through the outlet aperture 28 such that the compressed air forces the piston to rotate in an anti-clockwise direction, and the inlet aperture 27 becomes the exhaust port for the compressed air. Conversely, when the expanding chamber 34 is exposed to a vacuum through the inlet aperture 27, the vacuum pulls the piston in an anti-clockwise direction, with outlet aperture 28 acting as an inlet chamber to satisfy the vacuum. With such an arrangement, the compressed air and/or vacuum may be supplied from the action of rising and falling tides or waves compressing the air to drive the machine on the upward surge, and creating a vacuum the drive the machine on the downward surge. It will be appreciated that the action of both compressed air and vacuum driving the machine in this way will act to drive the piston in the same direction. Changing directions of tide or wave may be prevented from drawing air back through the same chamber by changeover valves positioned in the inlet and outlet, with the inlet and outlet apertures being modified depending on the mode of operation. Where the machine is used as an engine, the piston may be connected to a generator to produce electricity.

Other embodiments may use different means to drive the piston, such as wind energy, or water flowing through the machine.

Benefits

The advantages of the above arrangements are as follows.

The deformable 'moulding' characteristics of each vane allows the machine to adjust during operation to overcome any warpage, misalignment or inconsistencies in the components. Therefore, 'matching' of components is not necessary and 'bedding-in' of mating surfaces is not required, thus simplifying production and use.

The hinge is formed during operation, thus removing the need to accurately manufacture components, and reducing assembly time.

Equal positioning of four rotor walls, open configuration of the hinge abutment and perpendicular orientation of the ribs with relation to the walls avoids undercuts and allows the rotor to be moulded with simple straight opening actions of the mould pieces. Subsequent machining, or other secondary operations, is not required. In addition, the self-aligning nature of the components allows for a rapid assembly procedure as everything simply slides together.

When Nylon is used to construct the cylinder, it will absorb liquid lubricants and release them during operation to aid lubrication.

The plastic rotor may be moulded over a metallic shaft to provide torsional rigidity to polymers that exhibit elastic properties under load, whereupon the rotor's length may be exaggerated in relation to its diameter to provide high volume displacement of air in a confined space. This is particularly useful where large volumes low-pressure compressed air are required for light-duty applications, such as pneumatically operated water closets and building drainage systems.

The shaft is preferably provided with linear splines to transmit torque evenly along the rotor length and to provide a means to engage with a drive mechanism. The flexing action of the vanes allows hermetically sealed hinges to be formed with rotors whose high length to diameter ratio causes twisting under operational load such that unusually long rotors can be produced to increase the displacement capabilities of the machine.

The engine will run in a vertical, horizontal or angled mode.

It is to be appreciated that the embodiment of the invention described above with reference to the accompanying drawings has been given by way of example only and modifications may be effected.

The invention claimed is:

1. A rotary piston machine comprising a cylinder provided with two ends to form a stator, inlet and outlet apertures disposed in the stator, and a piston comprising a rotor eccentrically mounted within the stator, and at least one vane connected to the rotor and in communication with the cylinder to form an expanding and contracting chamber as the piston rotates, the or each vane being connected to the rotor by a hinge, the piston being provided with sealing means sufficient to restrict the movement of gaseous/fluid matter between chambers during operation; characterized in that the sealing means comprises a flexible seal member with a mating lip positioned adjacent to each vane hinge such that each revolution of the eccentrically mounted piston causes each flexible seal member to come into contact with an inner cylinder wall of the cylinder sufficiently to prevent the escape of displaced gaseous/fluid matter past the vane hinge, wherein the flexible seal member contacts the cylinder wall and bends to form a lip seal resistive to the direction of pressurization.

2. A rotary piston machine as claimed in claim 1, in which the sealing means is disposed on the piston in a position in which it is arranged to contact the cylinder wall as the chamber approaches bottom dead centre position to create a hermetic barrier to resist the transition of air between chambers.

3. A rotary piston machine as claimed in claim 1, in which the sealing means is provided on the vane.

4. A rotary piston machine as claimed in claim 1, in which the sealing means is provided on the rotor.

5. A rotary piston machine as claimed in claim 1, in which the sealing means is incorporated into the hinge.

6. A rotary piston machine according to claim 1, in which the rotor is provided with four of the vanes disposed around its periphery.

7. A rotary piston machine according to claim 1, in which the stator is provided with inlet and outlet apertures disposed in end caps located at the ends of the cylinder.

8. A rotary piston machine according to claim 7, in which the apertures in the end caps are such that as a chamber reaches the point of maximum expansion, the outlet aperture is configured to mimic the end profile of the chamber created by the surfaces of the rotor, vane and cylinder as it moves round to the point of maximum contraction where displacement ceases.

9. A rotary piston machine according to claim 1, in which at least one of the component parts of the rotary piston machine is made of a plastics material.

10. A rotary machine as claimed in claim 9, in which the cylinder is tapered and injection moulded.

11. A water closet including a rotary piston machine according to claim 1, the displaced air or vacuum generated during the operation of the rotary piston machine being used to operate the water closet.

12. A drainage system including a rotary piston machine according to claim 1, the displaced air or vacuum generated during operation of the rotary piston machine being used to assist transportation of water through the drainage system.

* * * * *

UNITED STATES PATENT AND TRADEMARK OFFICE

CERTIFICATE OF CORRECTION

PATENT NO. : 7,980,837 B2
APPLICATION NO. : 12/066517
DATED : July 19, 2011
INVENTOR(S) : Garry Moore It is certified that error appears in the above-identified patent and that said Letters Patent is hereby corrected as shown below:

On the Title Page, Item (54) and Col. 1, lines 1-2

SELF-ALIGNING ROTARY PISTONE MACHINE should be

SELF-ALIGNING ROTARY PISTON MACHINE

Signed and Sealed this
Eighth Day of November, 2011

David J. Kappos

David J. Kappos
*Director of the United States Patent and Trademark Office*